US005718329A

United States Patent [19]

Ippolito et al.

[11] Patent Number: 5,718,329

[45] Date of Patent: Feb. 17, 1998

[54] COMBINATION MULTIPLE CREDIT CARD HOLDER AND MONEY CLIP

[76] Inventors: Peter M. Ippolito; Caroline M. Cook, both of 9205 Brigadoon Cove, Austin, Tex. 78750

[21] Appl. No.: 677,669

[22] Filed: Jul. 8, 1996

[51] Int. Cl.[6] ..... A45C 11/18

[52] U.S. Cl. ..... 206/38; 206/39.1; 150/147

[58] Field of Search ..... 206/38, 449, 39, 206/39.1, 39.6, 425; D11/86, 87, 78.1; 224/252; 150/147

[56] References Cited

U.S. PATENT DOCUMENTS

| | | | |
|---|---|---|---|
| D. 372,358 | 8/1996 | Mathison | D11/78.1 |
| 1,845,509 | 2/1932 | Moran | 206/38 R |
| 3,027,995 | 4/1962 | Littman . | |
| 3,109,538 | 11/1963 | Boxer | 206/39.6 |
| 3,421,658 | 1/1969 | Cooksey . | |
| 4,056,139 | 11/1977 | Murt . | |
| 4,141,400 | 2/1979 | Mangan | 206/39.6 |
| 4,415,079 | 11/1983 | Ackeret | 206/425 |
| 4,674,628 | 6/1987 | Prinsloo et al. . | |
| 4,852,727 | 8/1989 | Oberle . | |
| 4,903,376 | 2/1990 | Rousseau . | |
| 5,077,869 | 1/1992 | Haase . | |
| 5,080,223 | 1/1992 | Mitsuyama . | |
| 5,115,909 | 5/1992 | Hull et al. | 206/38 |
| 5,337,813 | 8/1994 | Ritter . | |
| 5,358,019 | 10/1994 | Sumner, III . | |
| 5,431,207 | 7/1995 | Siegel . | |
| 5,520,230 | 5/1996 | Sumner, III | 206/39 |

*Primary Examiner*—Paul T. Sewell
*Assistant Examiner*—Nhan T. Lam

[57] ABSTRACT

A compartment is formed from the assembly of a bottom panel, a top panel, a right side panel, a left side panel, and a rear panel. The compartment is suitably sized so as to retain a multiple number of credit cards which are inserted into the compartment through a front opening and which are arranged inside the compartment in a stack and with a same physical orientation. The cards are securely retained inside the compartment by an integrated retention clip, and the cards are extracted from the compartment by means involving an integrated notch. A money clip affixed to the compartment provides a means for the retention of foldable paper currency.

11 Claims, 5 Drawing Sheets

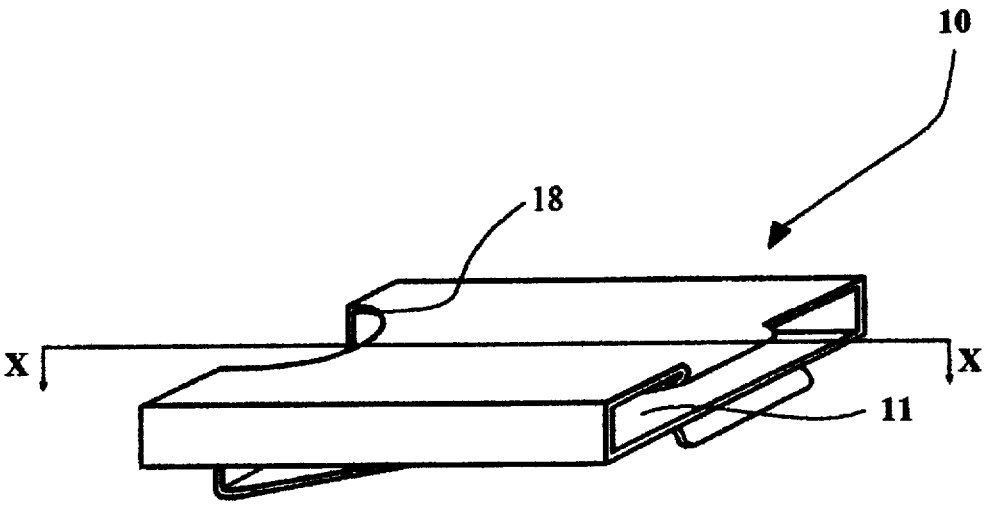
FIG. 1-A
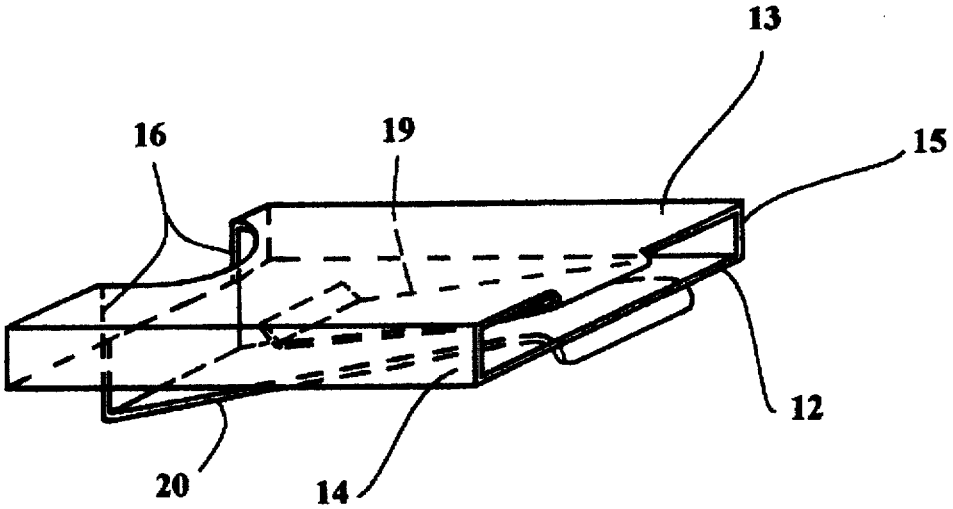
FIG. 1-B
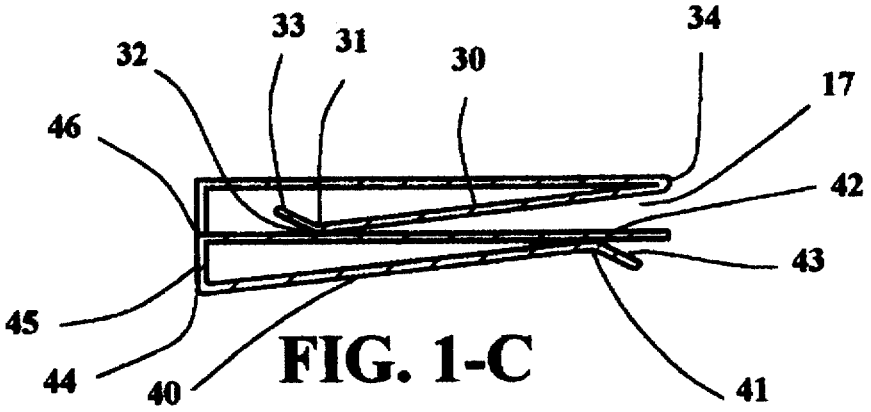
FIG. 1-C

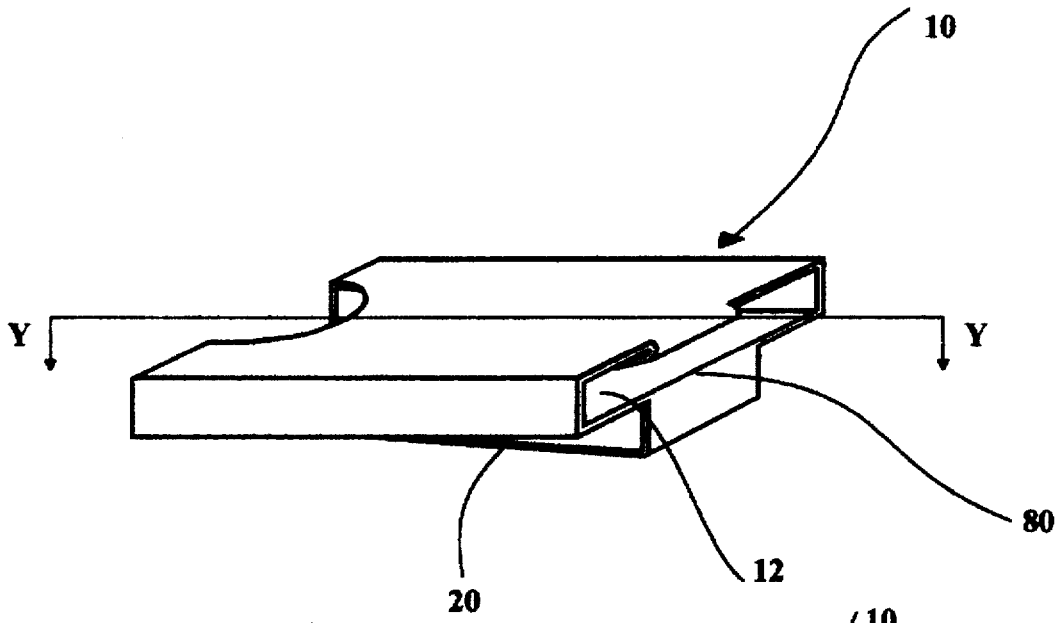
FIG. 5-A
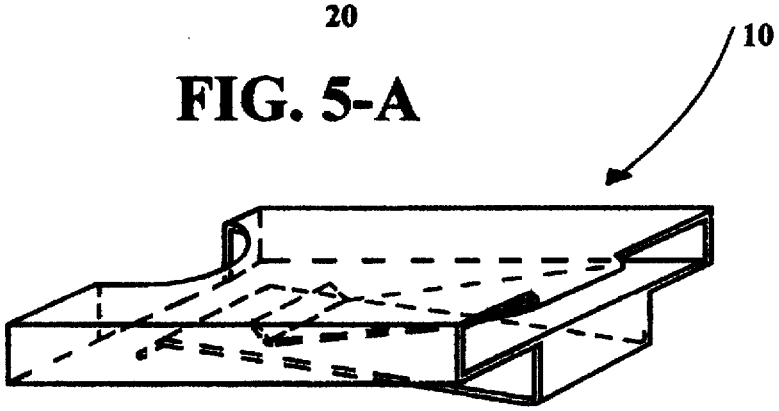
FIG. 5-B
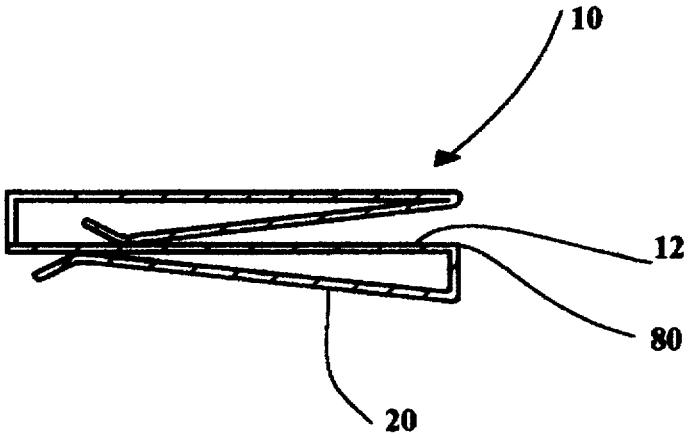
FIG. 5-C

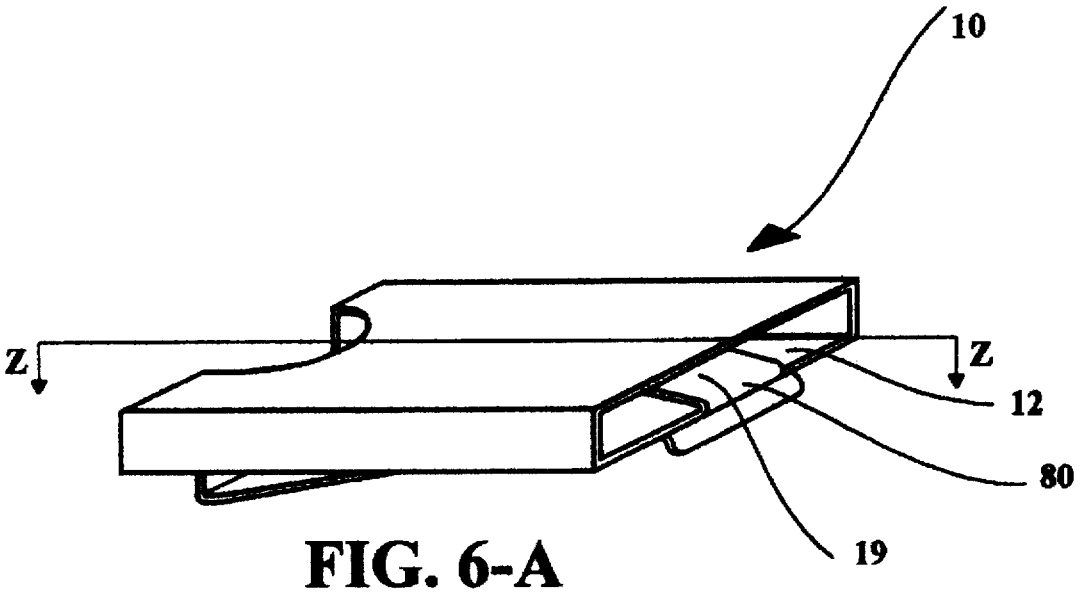
FIG. 6-A
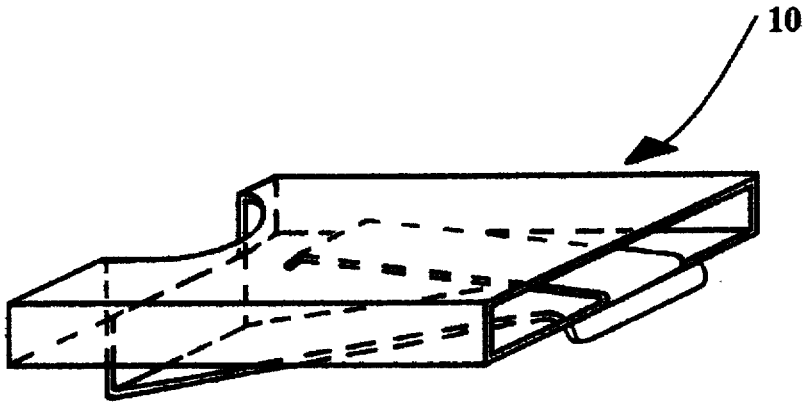
FIG. 6-B
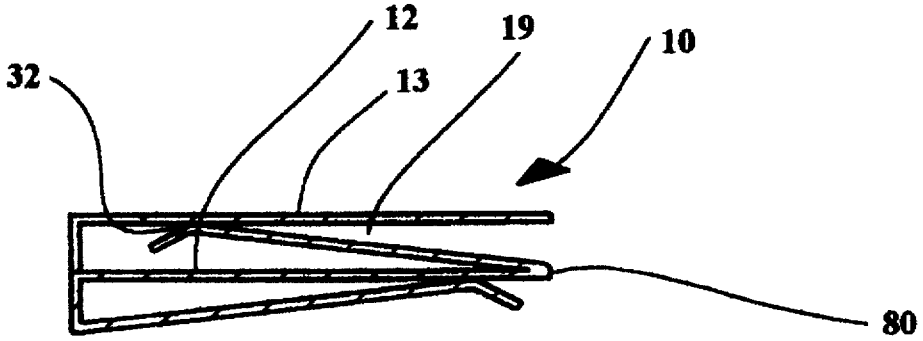
FIG. 6-C

COMBINATION MULTIPLE CREDIT CARD HOLDER AND MONEY CLIP

FIELD OF THE INVENTION

This invention relates to a device which functions as a combination credit card holder and money clip, specifically one that may be conveniently carried by an individual.

CROSS-REFERENCES TO RELATED APPLICATIONS

U.S. Pat. No. 3,027,995 April 1962 Littman
U.S. Pat. No. 3,421,658 January 1969 Cooksey
U.S. Pat. No. 4,056,139 November 1977 Murt
U.S. Pat. No. 4,141,400 February 1979 Mangan
U.S. Pat. No. 4,674,628 June 1987 Prinsloo et al.
U.S. Pat. No. 4,852,727 August 1989 Oberle
U.S. Pat. No. 4,903,376 February 1990 Rousseau
U.S. Pat. No. 5,077,869 January 1992 Haase
U.S. Pat. No. 5,080,223 January 1992 Mitsuyama
U.S. Pat. No. 5,115,909 May 1992 Hull et al.
U.S. Pat. No. 5,337,813 August 1994 Ritter
U.S. Pat. No. 5,358,019 October 1994 Sumner, III
U.S. Pat. No. 5,431,207 July 1995 Siegel
DES 372,358 August 1996 Mathison

DESCRIPTION OF THE PRIOR ART

It is necessary for individuals to carry credit cards, bank cards, identification cards, paper currency, and bank drafts for the transaction of daily commercial activities. Many prior art devices exist which permit an individual to organize, retain, and carry currency and the above mentioned cards in a manner which is practical. In particular, the prior art patented devices listed below are known to the inventors.

Inherent in each of the cited references are specific shortcomings which render these examples of the prior art inferior to the device which is proposed herein by the inventors. In particular:

Mathison proposes a combination credit card holder and money clip device which does not provide a means for the secure retention of a multiple number of cards, nor a means for the convenient removal of a multiple number cards.

Siegel proposes a card holder which retains and protects cards in a convenient manner but which does not offer a means for the simultaneous retention of currency. Also the card retention means proposed by Siegel differs from and is not as robust as the means proposed herein by the inventors.

Sumner, III proposes an ingenious combination card holder and money clip device which does not offer a means for fully protecting the retained cards from possible abrasion and exposure to moisture and contaminants.

Ritter proposes a card holder whose design is not well suited for the retention of a multiple number of cards, and whose design provides for the removal of only an individual card at a time from the holder. Also, the device proposed by Ritter does not include an additional means for the simultaneous retention of currency.

Hull et al. proposes a combination card holder and money clip which has a card retention means which is not suitable for the retention of a multiple number of cards.

Mitsuyama, like Siegle, proposes a device which retains and protects cards in a convenient manner but which does not offer the convenience of an integrated money clip. Also the card retention means proposed by Matsuyama differs from and is not as robust as the means proposed herein by the inventors.

Hass proposes a combination money and credit card carrier which, like the device proposed by Sumner III, does not offer a means for fully protecting the retained cards from possible abrasion and exposure to moisture and contaminants.

Rousseau proposes a card holder which allows for the retention of a multiple number of cards but which does not provide a robust means for organizing and protecting the cards to the degree that is provided by the device proposed herein by the inventors. Also, the device proposed by Rousseau does not include an additional means for the retention of currency.

Oberle proposes a card holder which allows for the retention and the simultaneous removal of a multiple number of cards but by means which are inherently more complicated and more difficult to implement than the means proposed herein by the inventors.

Prinsloo et al. propose a card holding device which allows for the convenient retention of a multiple number of cards but which does not provide a convenient means for the simultaneous removal of a multiple number of cards. Also, like the device proposed by Sumner, III, the device proposed by Prinsloo et al. does not offer a means for fully protecting the retained cards from possible abrasion and exposure to moisture and contaminants.

Mangan, like Ritter, proposes a card holder whose design is not well suited for the retention of a multiple number of cards, and whose design provides for the removal from the holder of only an individual card at a time. Also, like Ritter, the device proposed by Mangan does not include an additional means for the simultaneous retention of currency.

Murt proposes a device which allows for the retention and the simultaneous removal of a multiple number of cards but by means which are inherently more complicated and more difficult to implement than the means proposed herein by the inventors. Also the card retention means proposed by Murt differs from and is not as robust as the means proposed herein by the inventors.

Cooksey proposes a dispenser whose design is well suited for the retention of a multiple number of cards, but whose design does not provide means for the simultaneous removal of such cards. Also, the device proposed by Cooksey does not include an additional means for the simultaneous retention of currency.

Littman proposes a combination money clip and change box device which can conceivably also function as a combination money clip and card holder with means for the retention of a multiple number of cards. When used in such a manner however the device proposed by Littman provides no convenient means for the removal of the inserted cards and so would not function in a practical manner when used as a card holder.

SUMMARY OF THE INVENTION

It is desirable then to offer a combination credit card holder and money clip device which overcomes the limitations of the previously mentioned prior art embodiments. Accordingly, the objects and advantages of the combination credit card holder and money clip device proposed and described herein are:

(a) to provide a combination card holder and money clip device having means for the secure retention of a single card or a multiple number of cards;

(b) to provide a combination card holder and money clip device having means for the convenient removal of a single card or a multiple number of cards simultaneously;

(c) to provide a combination card holder and money clip device having means for the protection of all retained cards from possible harmful abrasion and exposure to moisture and contaminants;

(d) to provide a combination card holder and money clip device having means for the convenient simultaneous retention of credit cards and paper currency;

(e) to provide a combination card holder and money clip device which is relatively uncomplicated in its design and therefore relatively inexpensive to manufacture;

(f) to provide a combination card holder and money clip device which can be fashioned from a variety of materials such as metals or plastics;

Further objects and advantages are to provide a combination credit card holder and money clip device which is compact in its design, which can be easily manipulated by the human hand, which is aesthetically appealing in its design, and which has surfaces which can be cosmetically enhanced or monogrammed. Still further objects and advantages will be apparent from a consideration of the ensuing description and drawings.

BRIEF DESCRIPTION OF THE DRAWINGS

FIG. 1-A is a perspective view of a first embodiment of the invention showing the card compartment, the card retention clip, the finger notch, and the money clip.

FIG. 1-B is the same perspective view of the first embodiment of the invention as shown by FIG. 1-A but now showing phantom lines which indicate the full structure of the card retention clip and the money clip.

FIG. 1-C is a cross sectional view of the first embodiment of the invention taken along line X—X of FIG. 1-A.

FIG. 5-A is a perspective view of a second embodiment of the invention showing the card compartment, the card retention clip, the finger notch, and the money clip.

FIG. 5-B is the same perspective view of the first embodiment of the invention as shown by FIG. 5-A but now showing phantom lines which indicate the full structure of the card retention clip and the money clip.

FIG. 5-C is a cross sectional view of the second embodiment of the invention taken along line Y—Y of FIG. 5-A.

FIG. 6-A is a perspective view of a first embodiment of the invention showing the card compartment, the card retention clip, the finger notch, and the money clip.

FIG. 6-B is the same perspective view of the first embodiment of the invention as shown by FIG. 6-A but now showing phantom lines which indicate the full structure of the card retention clip and the money clip.

FIG. 6-C is a cross sectional view of the third embodiment of the invention taken along line Z—Z of FIG. 6-A.

DESCRIPTION OF THE PREFERRED EMBODIMENTS

Figure 2:
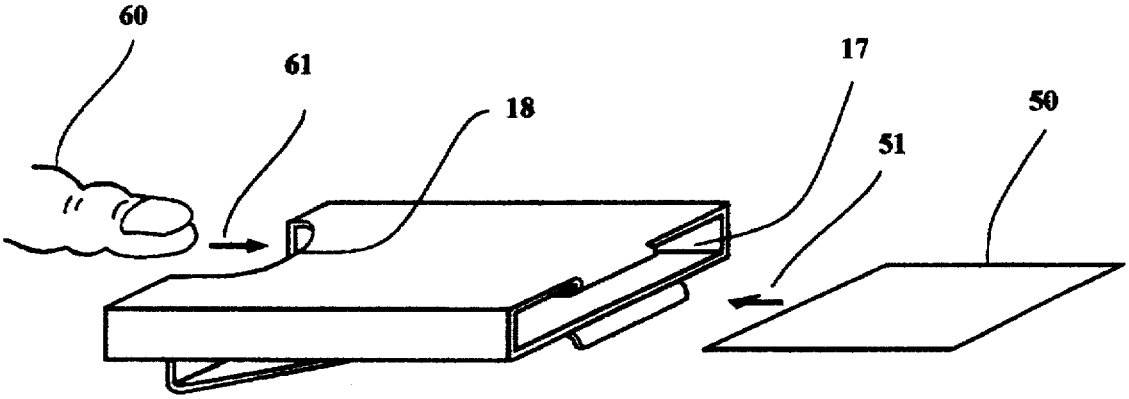
FIG. 2 illustrates the manner in which a card is inserted into and is extracted from the card holder.

Referring now to the drawings, FIG. 1-A, shows a first embodiment of the invention as designated by the numeral 10. The construction of invention 10 is such that a compartment 11 for the purpose of storing credit cards and the like is defined from the assembly of a bottom panel 12, a top panel 13, a left side panel 14, a right side panel 15, and a rear panel 16. It is to be understood that the fore mentioned designations of bottom panel, top panel, left side panel, right side panel, and rear panel as applied to elements 12 through 16 respectively are intended only as exemplary designations relative the perspective indicated by FIG. 1-A, and are not intended in any way as signifying a preferred orientation for the invention.

A front opening 17 is provided through which credit cards and the like may be inserted into compartment 11. It is to be understood that both compartment 11 and front opening 17 are to be sized accordingly such that credit cards may be inserted into compartment 11 without the need for undue force, and such that credit cards may be retained in compartment 11 without incurring warpage or deformation which is destructive to their normal structure.

A means for the removal of a single or a multiple number of credit cards which are retained in compartment 11 is provided by a notch 18 which is formed from the removal of material from top panel 13 and rear panel 16. Notch 18 is shaped in a fashion such that the removal of credit cards from compartment 11 through the application of lateral force by a human finger is facilitated. By designing notch 18 to extend along the complete vertical dimension of rear panel 16 the removal of a multiple number of retained credit cards from compartment 11 is facilitated. Notch 18 also extends sufficiently into the length of top panel 13 such that the application of lateral force from a human finger can result in a sufficient lateral displacement of the retained cards so as to facilitate the extraction of the cards through opening 17. The first embodiment of the invention shown by FIGS. 1-A, 1-B, and 1-C indicates a notch 18 of a generally circular shape. However it is to be understood that notches of alternate shapes such as V's, U's, or rectangles can be also be used.

A means for the secure retention of a multiple number of credit cards and the like inside compartment 11 is provided by a retention clip 19. Once a single card or a multiple number of cards have been inserted into compartment 11, retention clip 19 will exert a downward compressive force onto the upper face of the topmost inserted card and so provide a means by which a single inserted card or a stack of multiple inserted cards is compressed against the upper face of bottom panel 12. The compressive force provided by retention clip 19 acting with the frictional forces which exist between a single inserted card or a stack of multiple inserted cards and the upper face of bottom panel 19 then results in a clamping means by which the inserted card or cards are frictionally retained inside compartment 11.

In the first embodiment indicated by FIGS. 1-A, 1-B, and 1-C, a retention clip 19 is realized by a tabular element 30 which extends in a downward slope into compartment 11. An upward bend 31 in tabular element 30 results in a rounded surface 32 on the bottom side of tabular element 30 and in an upward sloping lip 33 at the unaffixed end of tabular element 30. Retention clip 19 is securely affixed to top panel 13 at edge 34, or as indicated by the first embodiment shown by FIGS. 1-A, 1-B, and 1-C, retention clip 19 is a formed integral and seamless extension of top panel 13 and is connected to and extends from edge 34.

It is desirable to affix retention clip 19 to top panel 13 in such a manner that, should compartment 11 be void of credit cards and the like, rounded surface 32 then becomes into contact with or becomes in the very near proximity of the upper face of bottom panel 12 as indicated by FIG. 1-C. It is also desirable that retention clip 19 be securely and rigidly affixed to top panel 13 at first edge 34, and that retention clip 19 be composed of such a material as metal or plastic which will respond to an applied deformative force with a force opposite to the direction of the applied deformative force. Once a single credit card and the like or a multiple number of credit cards are inserted into compartment 11 the inserted card or cards will be positioned in a manner such that they will lie between the upper face of bottom panel 12 and rounded surface 32 of retention clip 19. The presence of the inserted card or cards inside compartment 11 will then generate an upward deformative force which will act upon the body of retention clip 19. In responce to this upward deformative force, retention clip 19 will produce a downward compressive force which will serve to clamp the inserted card or cards between rounded surface 32 of retention clip 19 and the upper face of bottom panel 12. Through this clamping means then, the card or cards inserted into compartment 11 are retained in a secure manner until they are removed by the previously described means of the application of a lateral force to the cards through notch 18.

A means for the retention of paper currency, bank drafts, and commercial receipts is provided by a money clip 20 which functions in a manner which is previously well known to those skilled in the art. In the first embodiment indicated by FIGS. 1-A, 1-B, and 1-C, a money clip 20 is realized by a second tabular element 40 which extends in an upward slope towards the bottom face of bottom panel 12. A downward bend 41 in second tabular element 40 results in a convex rounded surface 42 on the upper side of second tabular element 40 and in a downward sloping lip 43 at the unaffixed end of second tabular element 40. A second bend 44 is also fashioned in second tabular element 40 so as to result in the formation of an offsetting element 45 at the end of second tabular element 40 which is opposite to the end containing downward sloping lip 43. Money clip 20 is affixed to the rear of bottom panel 12 at a second edge 46 as indicated by FIGS. 1-B and 1-C.

It is desirable to affix money clip 20 to bottom panel 12 such that, should no paper currency and the like be inserted into money clip 20, convex rounded surface 42 then becomes into contact with or into the very close proximity of the lower face of bottom panel 12 as indicated by FIG. 1-C. It is also desirable that money clip 20 be securely and rigidly affixed to bottom panel 12 at second edge 46, and that money clip 20 be composed of such a material as metal or plastic which will respond to an applied deformative force with a force opposite to the direction of the applied deformative force. Paper currency and the like is inserted into the money clip in a manner such that the inserted currency will lie between the lower face of bottom panel 12 and convex rounded surface 41 of the money clip 20. The presence of the inserted currency into money clip 20 will then generate a downward deformative force which will act upon the body of money clip 20. In responce to this downward deformative force, money clip 20 will produce an upward compressive force which will serve to clamp the inserted currency between convex rounded surface 41 of money clip 20 and the lower face of bottom panel 12. Through this clamping means then, the currency inserted into money clip 20 is retained in a secure manner until removed.

It is to be understood that both retention clip 19 and money clip 20 may be realized through different structures familiar to those skilled in the art without departing from the scope of this invention. For example, both retention clip 19 and money clip 20 may be affixed to a preferred panel or panels of compartment 11 through a hinged and sprung means rather than through a rigid means. Similarly, both retention clip 19 and money clip 20 may be realized from a multiple number of formed tabular elements rather than from a single formed tabular element as described previously herein.

Referring now to FIG. 2, the means by which credit cards and the like are inserted into and extracted from invention 10 is indicated. For purposes of example, a credit card is indicated by card 50. Card 50 is inserted into compartment 11 through front opening 17 in the direction that is indicated by arrow 51. Once fully inserted into compartment 11, card 50 will be securely retained inside compartment 11 by the previously described means involving retention clip 19. In order to extract card 50 from compartment 11, rightwise lateral force in the direction indicated by arrow 61 is applied by a finger 60 to those sections of card 50 which are exposed through notch 18.

Figure 3:
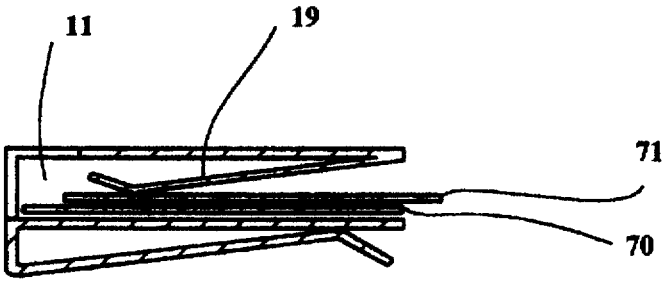
FIG. 3 is a cross sectional view of the first embodiment of the invention taken along line X—X of FIG. 1-A and showing the displacement of the retention clip once cards have been inserted into the card holder.

FIG. 3 shows a cross-sectional view of the invention 10 along the lines X—X that are indicated in FIG. 1-A. Cross sectional views of a first inserted card 70, and a second inserted card 71, are also indicated in FIG. 3. FIG. 3 indicates that with a single card or a multiple number of cards inserted into compartment 11, retention clip 19 is displaced in an upwardly direction, and when so displaced, retenion clip 19 will then exert a downward compressive force onto the inserted cards 70 and 71 and so provide a means by which the inserted cards are frictionally retained inside compartment 11.

Figure 4:
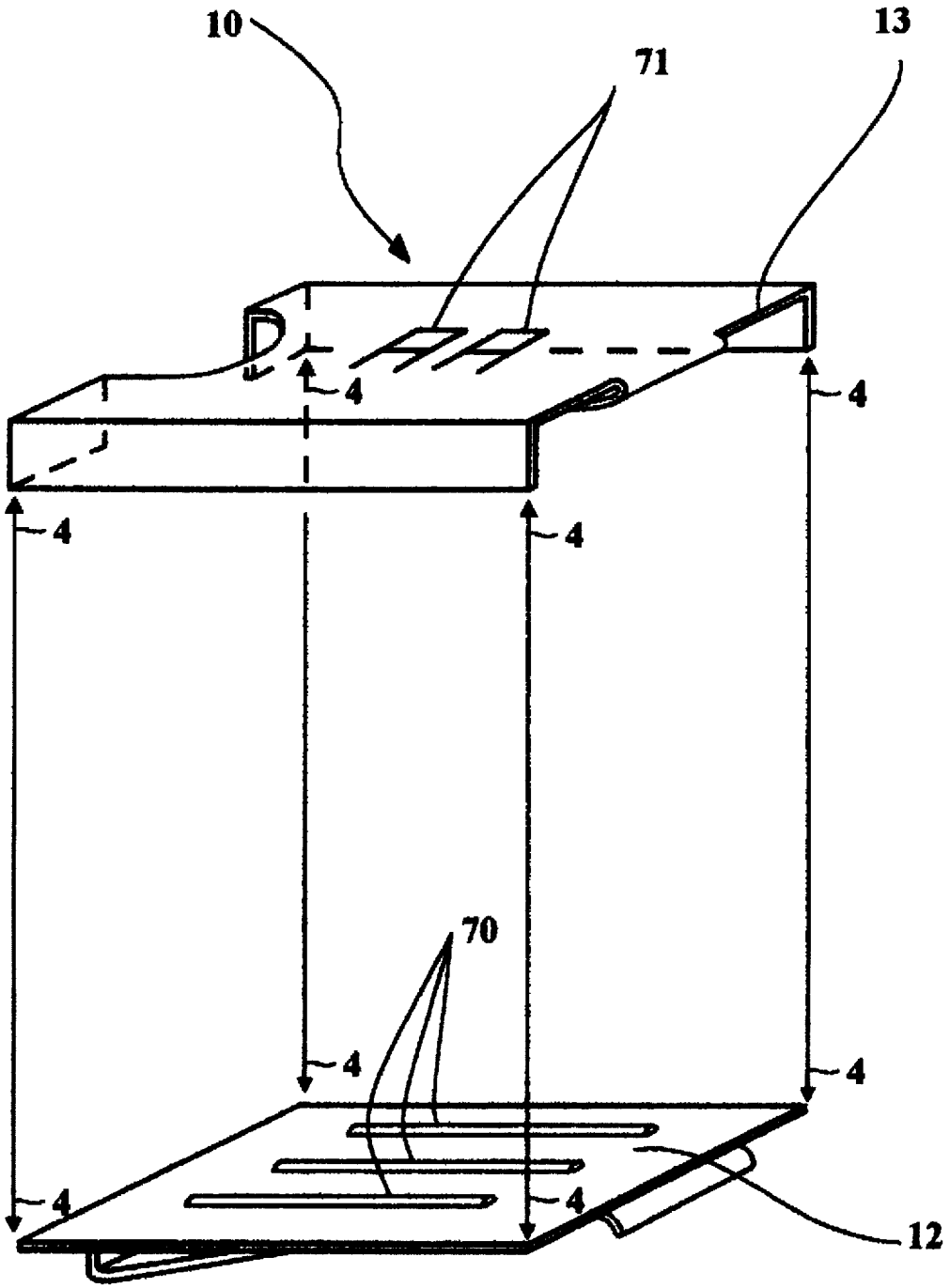
FIG. 4 is an exploded view of the first embodiment of the invention showing the incorporation of optional friction enhancing ridges into the structure of the bottom panel and optional monogramming into the structure of the the top panel.

FIG. 4 shows an exploded view of invention 10, wherein invention 10 has been exploded along the lines indicated by 4—4. Given this view of invention 10, optional ridges 70 are shown in the upper face of bottom panel 12. Ridges 70 are provided as a means for enhancing the frictional characteristics of bottom panel 12, and thereby improving the card retaining capability of invention 10. Ridges 70 may be incorporated into the structure of bottom panel 12 through standard means such as stamping, casting, molding, or other methods that are known to those skilled in the arts of fabrication. In general, the card retaining capability of invention 10 is improved if ridges 70 are incorporated into the structure of that particular panel in the assembly of compartment 11 which comes into contact with or is made to be into the closest proximity of rounded surface 32 of retention clip 19, and if ridges 70 are formed such that the raised surfaces of ridges 70 are made to come into contact with the face of the inserted card which is flush with the upper face of bottom panel 12. To facilitate the insertion of cards into compartment 11, or to facilitate the extraction of cards from compartment 11, ridges 70 should be oriented such that their length runs parallel to the direction in which cards are inserted into or extracted from compartment 11.

Also indicated by FIG. 4 are optional engraved characters 71 on the upper face of top panel 13. For purposes of example, the characters AA are shown as a possible choice for engraved characters 71. It is to be noted that in addition to providing a means for the protection of the retained cards from possible abrasion and exposure to moisture and contaminants, top panel 13 also provides a convenient means for incorporating personalized engravings in the form of engraved characters 71 into the structure of invention 10. In a similar manner, but not shown in FIG. 4, top panel 13 also provides a means by which various decorative items such as gemstones, carvings, or emblems may be affixed onto an outer surface of invention 10 in a convenient and prominent manner.

FIGS. 5-A, 5-B, and 5-C indicate a second embodiment of invention 10 wherein money clip 20 is now affixed to compartment 11 at bottom front edge 80 of bottom panel 12. By reversing the orientation of money clip 20, relative to the orientation of money clip 20 in the first embodiment shown by FIG. 1-A, the second embodiment shown by FIG. 5-A provides an alternate orientation for the retained paper currency and the like whereby the paper currency is now retained with an orientation which does not interfere with the insertion or the removal of credit cards from compartment 11 through front opening 17.

FIGS. 6-A, 6-B, and 6-C indicate a third embodiment of invention 10 wherein retention clip 19 is now affixed to compartment 11 at bottom front edge 80 of bottom panel 12. Retention clip 19 now extends in an upward slope into compartment 11 such that rounded surface 32 becomes into contact with or becomes into the very near proximity of the lower face of top panel 13 so that inserted cards and the like may be retained through compressive frictional means between the rounded surface 32 of retention clip 19 and the lower face of top panel 13. By inverting the orientation of retention clip 19, relative to the orientation of retention clip 19 in the first embodiment shown by FIG. 1-A, the third embodiment shown by FIG. 6-A provides an alternate orientation for the cards and the like which are inserted into compartment 11. In this third embodiment of invention 10 the inserted cards are now retained such that the uppermost of the retained cards is flush with the bottom face of top panel 13. By retaining the inserted cards in this manner, the third embodiment of invention 10 makes it possible to conveniently and prominantly display the uppermost of the retained cards through top panel 13 if top panel 13 is formed from a transparent material such as glass or clear acrylic. In this manner then, the third embodiment of invention 10 facilitates the convenient viewing of the uppermost of the inserted cards, which may be a preferred credit card or an identification document such as a drivers license, while the topmost card is still retained within compartment 11.

Accordingly it will be seen that the combination multiple credit card holder and money clip that is the invention described herein provides a convenient and practical means for the storage and organization of a multiple number of credit cards and the like and of paper currency and the like. The three embodiments of the invention described herein each provide a means for the secure retention of a single or a multiple number of credit cards and the like, and a means for the convenient removal of a single card or a multiple number of cards simultaneously. Also, the invention provides a means for protecting the retained cards and the like from possible abrasion and from exposure to moisture and contaminants. Finally the form of the invention is such that it is compact, can be easily manipulated be the human hand, and can be monogrammed or cosmetically enhanced.

Although the preceding description contains many specificities, these should not be construed as limiting the scope of the invention but as merely providing examples of some of the presently preferred embodiments of this invention. For example the finger notch may be of alternate shapes such as a V or a U, the compartment may be formed with rounded rather than square corner edges, the retention clip may be formed from multiple tabular elements each of which may be rigidly affixed to the card compartment or may be affixed through hinged and sprung means. Similarly the money clip may be formed from multiple tabular elements each of which may be rigidly affixed to the compartment or may be affixed through hinged and sprung means.

Many modifications, alterations and changes will become apparent to those skilled in the art to which this pertains. Thus the scope of the invention should be determined by the appended claims and their legal equivalents, rather than by the examples given.

The inventors claim:

1. A device for the simultaneous retention of rigid plastic cards and foldable paper currency, said device comprising:

a housing means for the encasement and retention of at least a single rigid plastic card, said housing means having a hollow structure, said housing means sized accordingly for the encasement of said rigid plastic cards, said housing means defined by the joining of a bottom panel, a top panel, a left side panel, a right side panel, a rear panel, and a front opening, said top panel being opposed to said bottom panel, said right side panel being opposed to said left side panel, said rear panel being opposed to said front opening, said front opening allowing for the insertion of said rigid plastic cards into said housing means, said front opening sized accordingly to permit the simultaneous insertion of more than a single said rigid plastic card into said housing means, a notch means to enable the convenient removal of at least a single said rigid plastic card that is retained within said housing means, said notch means comprised of the joining of a first notch section with a second notch section, said first notch section being formed of a cutout area from the body of said top panel, said second notch section being formed of a cutout area from the body of said rear panel, said first notch section partially exposing and providing access to the face of at least a single said rigid plastic card which is retained inside said housing means, said second notch section partially exposing and providing access to the edge of at least a single said rigid plastic card which is retained within said housing means, said joining of said first notch section with said second notch section occurring at the edge wherein said top panel joins said rear panel, a spring means for the secure retention within said housing means of at least a single said rigid plastic card which is inserted into said housing means, said spring means being affixed to an interior surface of said housing means, said spring means being contained within the interior of said housing means, said spring means acting to urge all said rigid plastic cards which are inserted into said housing means against a second interior surface of said housing means, a clip means for the retention of foldable paper currency, said clip means being affixed to the exterior surface of said housing means, said clip means being located external to said housing means, said clip means acting to urge said foldable paper currency against the exterior surface of said housing means.

2. The device of claim 1 wherein said housing means is made of a material which is clear thereby making the contents of said housing means visible.

3. The device of claim 1 wherein a portion of said housing means is made of a material which is clear thereby making a portion of the contents of said housing means visible.

4. The device of claim 1 wherein said second interior surface is made uneven for the purposes of increasing the frictional characteristics of said second interior surface.

5. A device for the simultaneous retention of rigid plastic cards and foldable paper currency, said device comprising:

a housing means for the encasement and retention of at least a single rigid platic card, said housing means having a hollow structure, said housing means sized accordingly for the encasement of said rigid plastic cards, said housing means defined by the joining of a bottom panel, a top panel, a left side panel, a right side panel, a rear panel, and a front opening, said top panel being opposed to said bottom panel, said right side panel being opposed to said left side panel, said rear panel being opposed to said front opening, said front opening allowing for the insertion of said rigid plasic cards into said housing means, said front opening sized accordingly to permit the simultaneous insertion of more than a single said rigid plastic card into said housing means, a notch means to enable the convenient removal of at least a single said rigid plastic card that is retained within said housing means, said notch means comprised of the joining of a first notch section with a second notch section, said first notch section being formed of a cutout area from the body of said top panel, said second notch section being formed of a cutout area from the body of said rear panel, said first notch section partially exposing and providing access to the face of at least a single said rigid plastic card which is retained inside said housing means, said second notch section partially exposing and providing access to the edge of at least a single said rigid plastic card which is retained within said housing means, said joining of said first notch section with said second notch section occurring at the edge wherein said top panel joins said rear panel, a spring means for the secure retention within said housing means of at least a single said rigid plastic card which is inserted into said housing means, said spring means being formed of at least a single first resilient tabular element, one end of said first resilient tabular element being affixed to a first interior surface of said housing means, the body of said first resilient tabular element being contained within the interior of said housing means, the body of said first resilient tabular element positioned so as to make contact with at least a single said rigid plastic card which is inserted into said housing means, said first resilient tabular element acting to urge the said rigid plastic cards inserted into said housing means against a second interior surface of said housing means, said second interior surface being opposed to said first interior surface, a clip means for the retention of foldable paper currency, said clip means being formed of at least a single second resilient tabular element, one end of said second resilient tabular element being affixed to the exterior of said housing means, the body of said second resilient tabular element being exterior to said housing means, the body of said second resilient tabular element positioned so as to make contact with said foldable paper currency, said second resilient tabular element acting to urge said foldable paper currency against an opposed exterior surface of said housing means.

6. The device of claim 5 wherein said housing means is made of a material which is clear thereby making the contents of said housing means visible.

7. The device of claim 5 wherein a portion of said housing means is made of a material which is clear thereby making a portion of the contents of said housing means visible.

8. The device of claim 5 wherein said second interior surface is made uneven for the purposes of increasing the frictional characteristics of said second interior surface.

9. The device of claim 5 wherein said one end of said first resilient tabular element is affixed to the interior surface of said top panel of said housing means, and wherein said one end of said second resilient tabular element is affixed to the exterior surface of said bottom panel of said housing means.

10. The device of claim 5 wherein said one end of said first resilient tabular element is affixed to the interior surface of said bottom panel of said housing means, and wherein said one end of said second resilient tabular element is affixed to the exterior surface of said bottom panel of said housing means.

11. The device of claim 5 wherein said one end of said first resilient tabular element is affixed to the interior surface of said bottom panel of said housing means, wherein said one end of said second resilient tabular element is affixed to the exterior surface of said bottom panel of said housing means, and wherein said top panel is made of a material which is clear thereby making visible said rigid plastic card which is adjacent to the interior surface of said top panel.

* * * * *